US006237918B1

(12) United States Patent
Williams

(10) Patent No.: US 6,237,918 B1
(45) Date of Patent: May 29, 2001

(54) RING AND BALL TOSSING GAME APPARATUS AND METHOD FOR PLAYING THE SAME

(76) Inventor: Charles E. Williams, 1511 Lucille Ave., Venice, CA (US) 90291

( * ) Notice: Subject to any disclaimer, the term of this patent is extended or adjusted under 35 U.S.C. 154(b) by 0 days.

This patent is subject to a terminal disclaimer.

(21) Appl. No.: 09/374,952

(22) Filed: Aug. 16, 1999

Related U.S. Application Data

(63) Continuation of application No. 09/063,586, filed on Apr. 21, 1998, now Pat. No. 5,938,202.

(51) Int. Cl.[7] ..... A63B 67/06
(52) U.S. Cl. ..... 273/336
(58) Field of Search ..... 273/336, 337, 273/338, 339

(56) References Cited

U.S. PATENT DOCUMENTS 4,898,392 2/1990 Goletz .
5,779,567 7/1998 Durso .
5,938,202 * 8/1999 Williams ..... 273/336

OTHER PUBLICATIONS

Copyright Certificate of Registration Dated Mar. 27, 1995 (8 pages).
Nondisclosure Agreement dated May 10, 1996 (2 pages).

* cited by examiner

*Primary Examiner*—Raleigh W. Chiu
(74) *Attorney, Agent, or Firm*—Christie, Parker & Hale, LLP

(57) ABSTRACT

A ring and ball tossing game apparatus is provided for use in playing a ring and ball tossing game according to a method of play. The game apparatus includes a ring-shaped element called a "root", at least two stakes, and a ball. The root has a shape which permit easier rolling of the ball into the root. The game is played by players on opposing teams standing behind their respective stakes which are separated a distance apart, throwing the root toward their opponent's stake, and then throwing the ball toward either the root or the opponent's stake. Points are scored according to where the root and ball land, how they land, what they contact, and where the ball travels when it is tossed or thrown. Game play ends when a player's score reaches a set number of points or when a player lands the ball within the root which itself encircles the opponent's stake.

7 Claims, 6 Drawing Sheets

RING AND BALL TOSSING GAME APPARATUS AND METHOD FOR PLAYING THE SAME

This is a continuation of application Ser. No. 09/063,586 filed on Apr. 21, 1998, now U.S. Pat. No. 5,938,202.

FIELD OF THE INVENTION

This invention relates to games and amusement devices, and more particularly to ring and ball tossing games and the objects and methods used in playing such games.

BACKGROUND

A large number of tossing games exist which test the skill of each player to aim, throw or roll, and properly land rings, balls, or other objects in relationship to each other and/or to other objects or surroundings. Examples of such games include lawn bowling, horseshoes, boccie ball, and croquet. Though each of these games provide entertainment, each requires either a large amount of playing space which must usually be outdoors, a playing area of a particular nature (e.g., flat, grassy lawn, etc.), or several game pieces which are often cumbersome or inconvenient to carry. For apartment dwellers or those who live in homes with small yards or no yards at all, such games often require players to leave their homes or neighborhoods to find suitable playing areas.

Other problems exist with each of the games mentioned above. For example, the game of horseshoes typically results in damage to the playing area from horseshoes impacting the lawn or yard on which the game is played. In addition, heavy metal stakes driven into the playing surface also cause damage to the lawn or yard. Most of the games mentioned above require little to no strategy, and for those that do, children can very rarely play competitively with adults.

Therefore, there is a need for a tossing game which may be played in almost any location (indoors or outdoors), which does not require large amounts of space, which has very few playing parts, which does not cause damage to the surface on which the game is played, which requires a degree of real strategy in game play, but in which playing competitiveness is largely independent of the age of players. The present invention provides such a game.

SUMMARY OF THE INVENTION

A ring and ball tossing game apparatus is provided for use in playing a ring and ball tossing game according to a method of play. Elements of the apparatus include at least two stakes, a ball, and a ring-shaped object called a "root". The "root" has a front portion which is preferably sloped in a downward direction to more easily permit the ball to roll up and into the center of the root when the root is resting on a playing surface. The "root" may have a hand grip and/or finger grips for a player to more comfortably and securably hold the "root". The stakes may be one-piece or dismantle able into multiple pieces, and may be of a type to be driven into the ground or may be supported on bases to be used on hard surfaces or indoors. One or more parts of the stakes may be hollow to generate louder sounds when impacted by the root or ball during play.

When playing the game, players on opposing teams stand behind their own respective stakes which are located a distance apart from one another. Game play commences by a player from one team first tossing or rolling the root from behind the player's stake toward the opponent's stake and then tossing or rolling the ball from behind the player's stake toward the root or the opponent's stake. Points are tallied according to where the root and ball land, how they land, what they contact, and where the ball travels when it is tossed or thrown. Unless the game has been tied at the end of a round of play (in which case the game continues until the tie is broken), the first person scoring a set number of points or who causes the ball to land inside the root which itself encircles the opponent's stake wins.

DETAILED DESCRIPTION

Figure 1B:
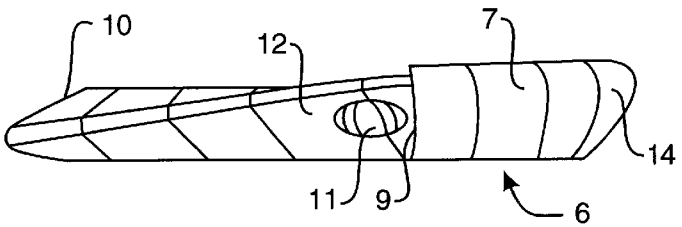
FIG. 1*b* is a side view of the root.
Figure 1C:
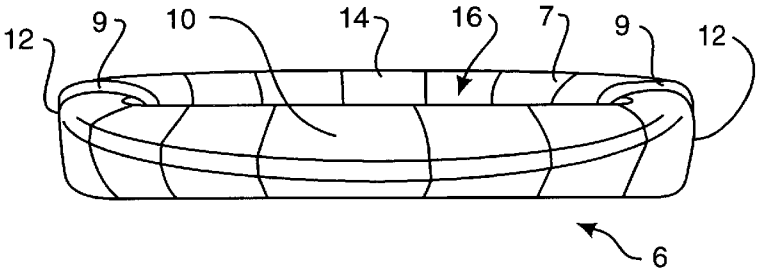
FIG. 1*c* is a front view of the root.

In the game of the present invention, the following game pieces are used: at least two stakes 2 and 4, at least one ring or "root" 6, and at least one ball 8. Each game piece will be described below, followed by a description of the manner in which the game is played.

FIGS. 1*a*–1*e* are various views of root 6 (with contour lines added for clarity). Root 6 is ring-shaped, and may be made from any number of materials, such as wood, metal, plastic, rubber, clay, or composites. Though root 6 is shown in FIGS. 1*a*–1*e* as being a solid ring, root 6 may instead be a hollow ring, may be made of foam material, or may be a hollow ring filled with foam material.

Preferably, root 6 has an asymmetrical shape as shown in FIGS. 1*a*–1*e*. The asymmetrical shape of root 6 includes a front portion 10 which is sloped in a downward direction and side and rear portions 12 and 14, respectively. The purpose of sloped front portion 10 is to permit ball 8 to be more easily rolled into the center 16 of root 6 when root 6 lies on a playing surface. The fact that side and rear portions 12 and 14 do not have the pronounced downward slope of front portion 10 prevents ball 8 from rolling away from center 16 of root 6. Thus, root 6 has a "ball-friendly shape", such that when ball 8 is rolled toward the front portion 10 of root 6 lying on a playing surface, ball 8 is encouraged to roll into center 16 of root 6 and is prevented from easily escaping once inside center 16 of root 6. Although root 6 is shown in FIGS. 1*a*–1*e* as having only front portion 10 sloped in a downward direction, a larger portion or all of the circumference of root 6 may be sloped in such a manner. However, the shape shown in FIGS. 1*a*–1*e* is the preferred shape of root 6 according to the present invention.

Though not necessary to practice the present invention, root 6 preferably has a hand grip 7 which preferably surrounds a section of root 6. More particularly, hand grip 7 preferably surrounds rear portion 14 of root 6 as shown in FIGS. 1*a*–1*e*. Hand grip 7 preferably is stepped with respect to adjoining sections of root 6 not covered by hand grip 7 (see steps 9 in FIGS. 1*a*–1*e*). Hand grip 7 provides a comfortable and secure grip for a player holding, tossing, or rolling root 6. Hand grip 7 is preferably made from an elastomeric material (such as rubber, urethane, plastic foam, etc.) and is preferably secured to rear portion 14 of root 6 by being molded therearound. Hand grip 7 may also be cast, formed, bonded around or glued in place around rear portion 14 of root 6. Hand grip 7 need not necessarily surround rear portion 14 of root 6, and need not necessarily be made from an elastomeric material. For example, hand grip 7 may instead be made of wood, composites, metal, ceramic, etc. Also, hand grip 7 may instead be located on any other portion of root 6. Hand grip 7 may also define the entire section of root 6 to which it is attached (rather than the hand grip material only surrounding a section of root 6 as shown in FIG. 1*e*). In this regard, the hand grip section of root 6 may be attached to adjoining sections of root 6 in any number of methods well known in the art, such as by being molded, cast, glued, bonded, press-fit, or welded together, fastened together with threaded fasteners or other conventional fasteners, etc.

Figure 1E:
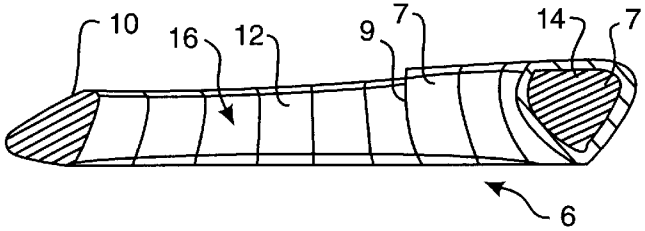
FIG. 1*e* is a cross-sectional view of the root shown in FIGS. 1*a*–1*d*, taken along line 1—1 in FIG. 1*d*.
Figure 1A:
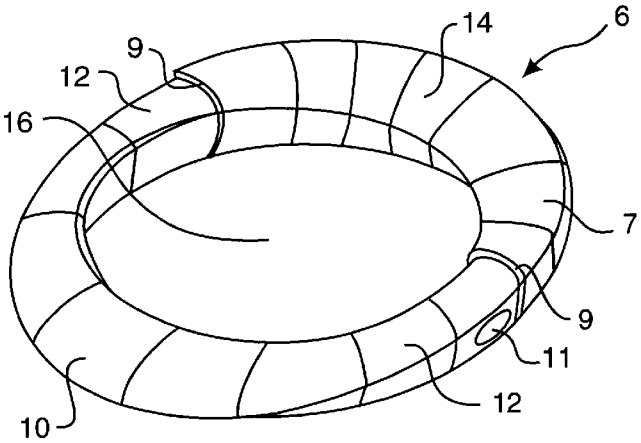
FIG. 1*a* is a perspective view of the ring ("root") of the present invention.
Figure 1D:
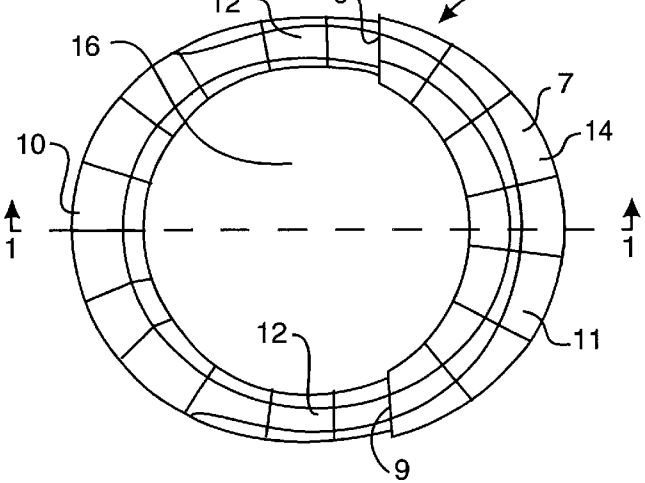
FIG. 1*d* is a top view of the root.

For additional user grip and comfort, root 6 may be provided with finger grips 11 (see FIGS. 1*a* and 1*b*). Finger grips 11 are preferably a pair of indentations in side portions 12 of root 6, and are located adjacent to hand grip 7 to allow a user to grip hand grip 7 while pressing a finger into a finger grip 11. Although finger grips 11 are preferably located as just described, any number of finger grips 11 may be located on any portion of root 6—either in root 6, in hand grip 7, or in both root 6 and hand grip 7. Also, finger grips 11 may be made in any shape to accommodate a user's finger tip (as shown in FIGS. 1*a* and 1*b*), a user's entire finger, or even a number of a user's finger tips or fingers.

Figure 2:
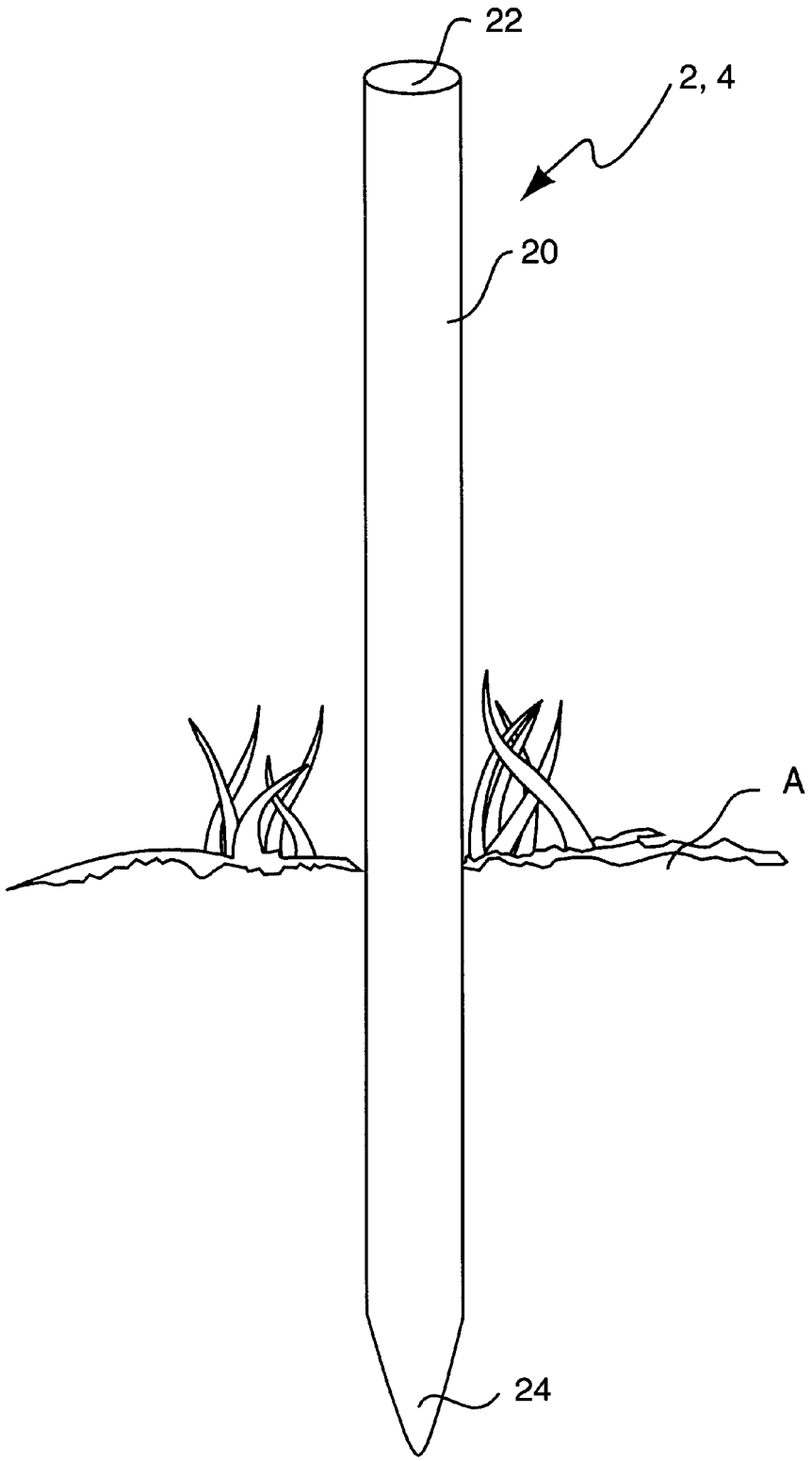
FIG. 2 is an elevational side view of the stake of the present invention according to a first preferred embodiment.

FIGS. 2–4*b* show three different embodiments of the stakes used in the present invention. Stake 20 shown in FIG. 2 is intended to-be used when the game-is played outdoors (on a lawn, for example). Stake 20 is a solid one-piece element, and may take any number of stake designs which are well-known in the art. Preferably, stake 20 has an impact end 22 (which may be rounded—not shown) for use when stake 20 is driven into the ground (indicated generally at A) by a hammer or other object, and a pointed end 24 to facilitate easier insertion into the ground.

Figure 3:
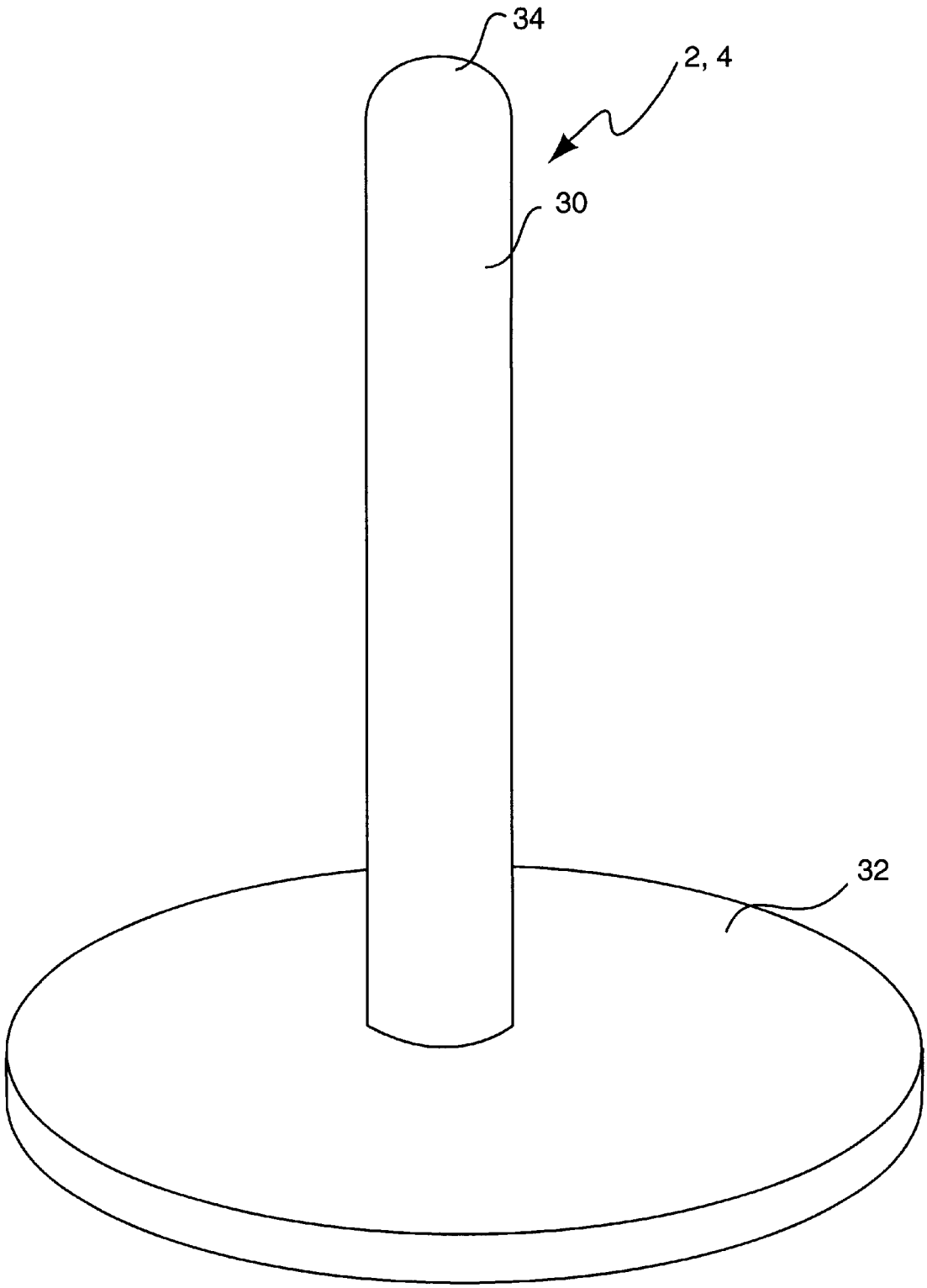
FIG. 3 is an elevational side view of the stake of the present invention according to a second preferred embodiment.

FIG. 3 shows another embodiment of the stake used in the present invention. Stake 30 is intended for use when the present invention is played indoors. For this reason, stake 30 is not driven into the ground, but is attached to a base 32 which supports stake 30. The top end 34 of stake 30 may be rounded (as shown). Base 32 is shown as a round disc to which stake 30 is attached, but may take any number of shapes and forms well-known in the art to support stake 30 in an upright position. Stake 30 and base 32 are shown in FIG. 3 as a one-piece unit (e.g., by molding). However, stake 30 and base 32 may instead by separate elements connected to each other in any number of ways well-known in the art (such as through a threaded connection between stake 30 and base 32, or by welding, gluing, bolting, nailing, riveting, press-fitting, etc.). Stake 30 may also be detachable from base 32 for compact storage of stake 30 and base 32.

Figure 4A:
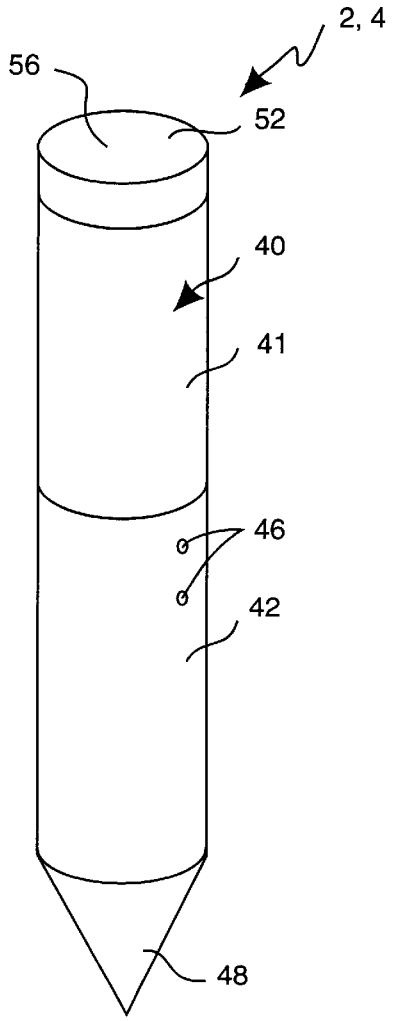
FIG. 4*a* is an elevational side view of the stake of the present invention according to a third preferred embodiment.
Figure 4B:
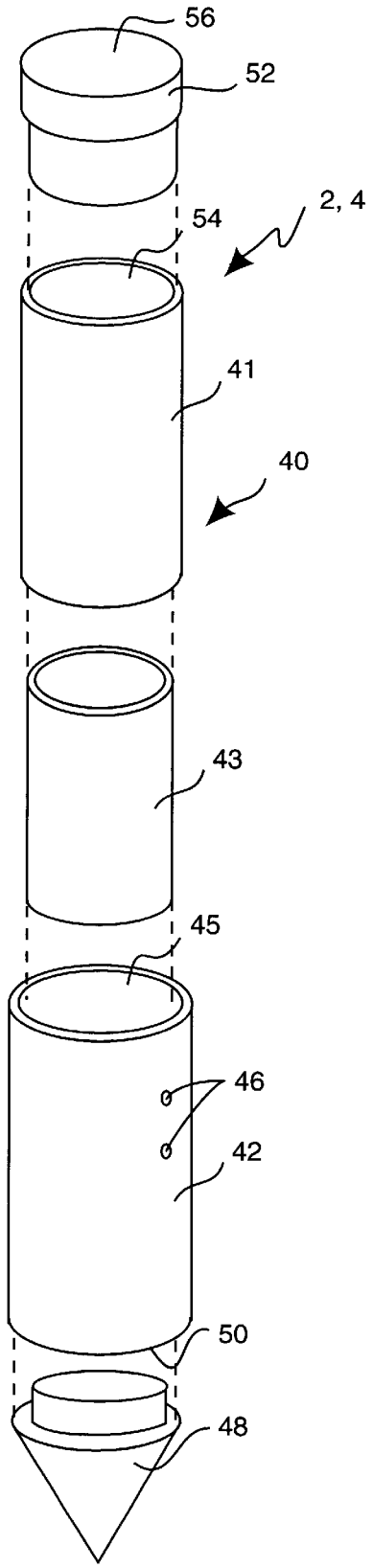
FIG. 4*b* shows an exploded view of the stake shown in FIG. 4*a*.

FIGS. 4*a* and 4*b* show the preferred embodiment of the stake used in the present invention. Stake 40 is a modified version of stake 20 described above, but such modifications may be made just as effectively with an indoor stake such as stake 30 also described above. Unlike stake 20, stake 40 has multiple detachable parts which permit stake 40 to be dismantled into two or more shorter tubes (e.g., upper tube 41, and lower tube 42) for compact storage. In the preferred embodiment, upper tube 41 and lower tube 42 are connected via connecting tube 43, which preferably is permanently secured to lower tube 42 by being staked into place in upper end 45 of lower tube 42 (see dimples 46 in lower tube 42, which are staked into lower tube 42 when connecting tube 43 is fitted in place therein). Preferably, tip 48 of stake 40 is press fit into lower end 50 of lower tube 42. End cap 52 preferably slides into upper end 54 of upper tube 41. End cap 52 preferably has a flat top 56, thereby enabling stake 40 to be driven into the ground by a hammer or other instrument used to impact flat top 56. Preferably, end cap 52 has a clearance fit within upper end 54 of upper tube 41, thereby permitting a user to remove and replace end cap 52 (after driving stake 40 into the ground) with another end cap having one of a number of possible shapes (such as a rounded end similar to the rounded end of stake 30, etc.).

Though stake 40 is preferably made of upper and lower tubes 41, 42, more tubes may be used to dismantle stake 40 into an even more compact size. Also, it will be appreciated that tubes 41, 42 may be connected in any number of ways commonly known to those skilled in the art (such as by being screwed together via threads on each tube, through a snap-fit of one tube's end into the end of another tube, a light press fit between tubes, etc.). Although end cap 52 is preferably removable by a user, while tip 48 is not, either of these elements may be made to be permanently secured in place or removable within their respective tubes 41, 42. The connection between end cap 52 and upper tube 41 and the connection between tip 48 and lower tube 42 may also be of any conventional type described above with respect to the connection between tubes 41 and 42. End cap 52 or tip 48 (or both) may even be integral with their respective tubes, 41, 42. Additionally, it should be noted that either or both tubes 41 and 42 may be solid or have solid sections. One or more hollow sections of tubes 41, 42 permits stake 40 to emit a louder sound when struck by an object during play (described below).

Any or all parts of stakes 20, 30, and 40 may be made from a number of materials, such as wood, metal, plastic, rubber, or composites.

Ball 8 may be of several types, such as a baseball, softball, racquetball, or tennis ball, and may be made of any number of materials well-known in the ball-making art, including foam.

To set up the game of the present invention, stakes 2 and 4 are placed a distance apart from one another (preferably 20–30 feet).

Figure 5:
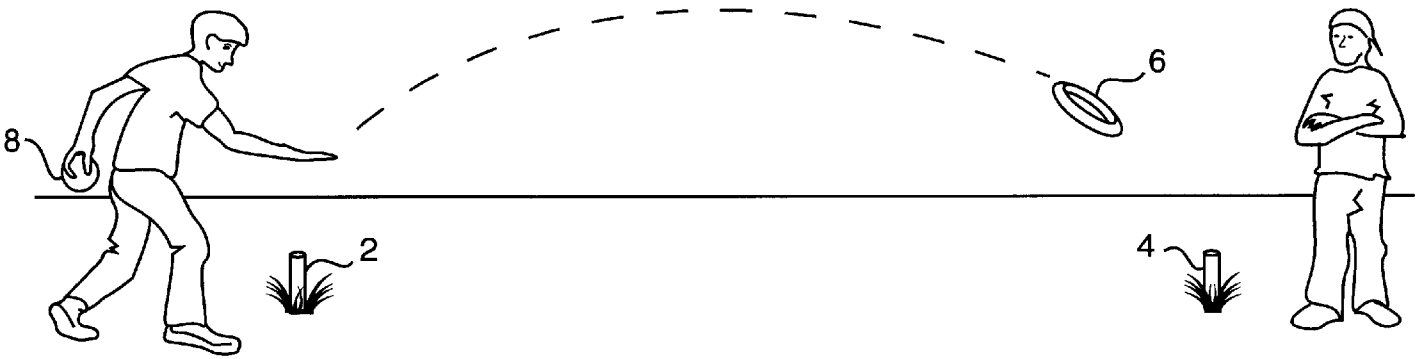
FIG. 5 is a side view of the playing area set up according to the method of the present invention, showing the first step of play in a player's turn.
Figure 6:
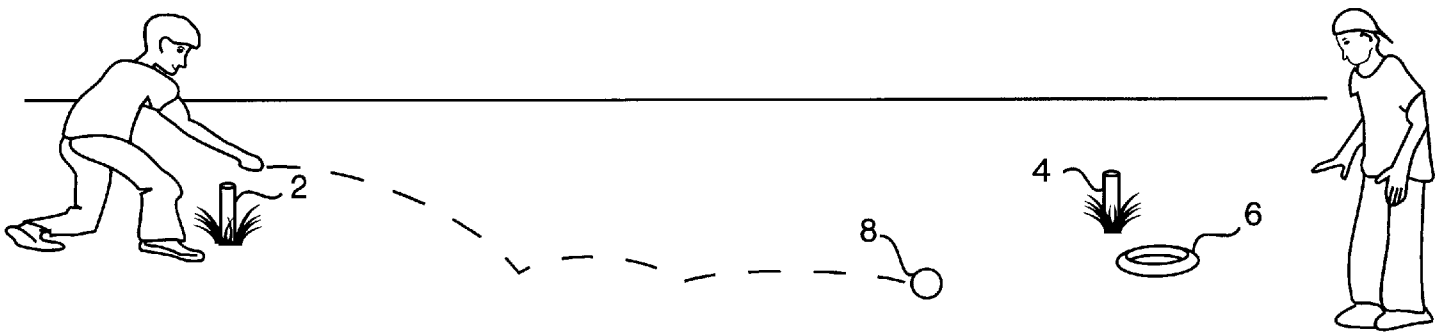
FIG. 6 is a side view of the playing area set up according to the method of the present invention, showing the second step of play in a player's turn.
Figure 7A:
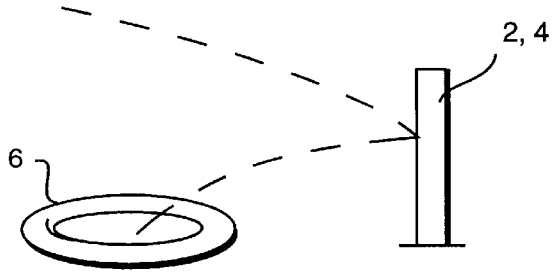
FIG. 7*a* is a front view of a first type of scoring in the first step of a player's turn according to the present invention.
Figure 7B:
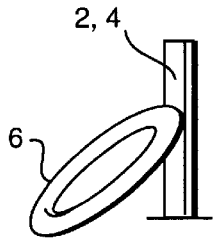
FIG. 7*b* is a front view of a second type of scoring in the first step of a player's turn.
Figure 7C:
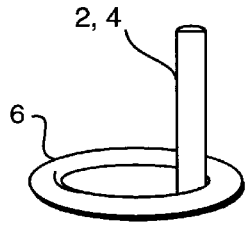
FIG. 7*c* is a front view of a third type of scoring in the first step of a player's turn.
Figure 7D:
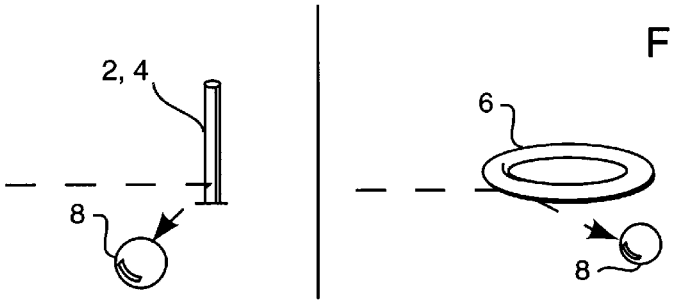
FIG. 7*d* is a front view of a first type of scoring in the second step of a player's turn.
Figure 7F:
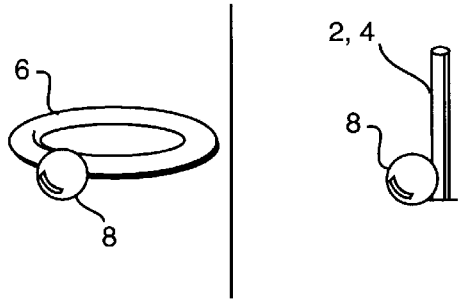
FIG. 7*f* is a front view of a third type of scoring in the second step of a player's turn.
Figure 7E:
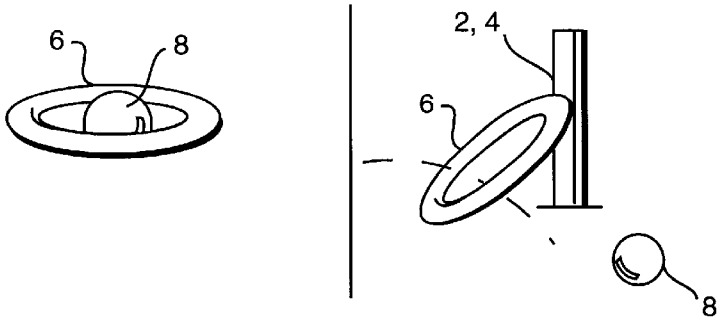
FIG. 7*e* is a front view of a second type of scoring in the second step of a player's turn.
Figure 7G:
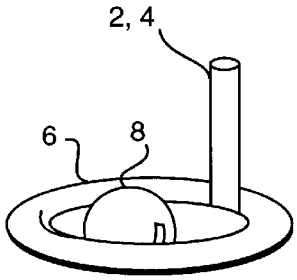
FIG. 7*g* is a front view of a fourth type of scoring in the second step of a player's turn.
Figure 7H:
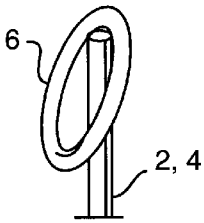
FIG. 7*h* is a front view of a fourth type of scoring in the first step of a player's turn.

Game play is divided into turns; alternating turns for each team. Each turn has two steps. To begin play, a player from the first team stands behind his or her own stake 2 facing his or her opponent's stake 4 (see FIG. 5). Though in FIGS. 5 and 6 the tossing/rolling player is shown standing immediately behind his respective stake 2, the tossing/rolling player may stand anywhere behind an imaginary line extending laterally (at a ninety degree angle with respect to a line extending between stakes 2, 4) from his own stake. This rule is subject to the "deep space Saturn" rule described below. In step one, as shown in FIG. 5, the player from the first team tosses or rolls root 6 from behind his or her stake 2, 4 toward the opponent's stake 4, 2. In step two, as shown in FIG. 6, the player then tosses or rolls ball 8 from behind his or her own stake 2, 4 toward either the opponent's stake 4, 2 or root 6, or toward both the opponent's stake 4, 2 and root 6. Depending upon where root 6 and ball 8 land, how they land, what they contact, and where ball 8 travels when it is tossed or thrown, points are scored as discussed below and illustrated in FIGS. 7*a*–7*h*. The first player to reach a set number of points or the player with the highest total number of points at the end of a set number of rounds wins. Preferably, the player reaching 12 points wins (providing that both players have had an equal number of turns). Also preferably, a game may not end in a 12—12 tie, but must continue until both players have had the same number of turns with one player having a higher score than his or her opponent. However, if a player causes root 6 to encircle both his opponent's stake 2, 4 and ball 8, that player automatically wins, and the opposing player is not given an opportunity to score again. After the player from the first team has finished throwing root 6 and ball 8, if the game has not been won, the steps described above are performed by a player from the second team against the first team's stake 2.

If root 6 never rolls or lands closer than a set distance (preferably, 6 feet) from the opponent's stake 2, 4, the root 6 is not deemed "playable" and is called a "short". In such a case, the player who has thrown root 6 is penalized, and may not score further points in that turn unless during the ball-throwing step the player hits the opponent's stake 2, 4 with ball 8 (in which case the penalty is "erased" and the score tallied as normal for the player's turn). If the player does not "erase" the penalty as just described, the opposing player in his or her next turn need not throw from behind his or her stake 2, 4 for his or her turn, but may instead step up to (and throw both root 6 and ball 8 from) the location where the "short" root 6 landed.

If a root 6 comes to rest past (beyond) the opponent's stake 2, 4, and then the ball 8 comes to rest inside of the root 6 (called a "deep space Saturn"), the opponent in his or her next turn may not step up to his or her stake 2, 4 to throw, but must throw both root 6 and ball 8 from the exact location of the "deep space Saturn".

Scoring the game of the present invention is preferably as follows:

Throwing Root 6

If root 6 thrown or rolled by a player contacts the opponent's stake 2, 4, at any time during the player's turn (see FIG. 7*a*), 1 point is scored for the player.

If root 6 thrown or rolled by a player comes to rest leaning against the opponent's stake 2, 4, and remains in such a position after ball 8 is thrown in that player's turn (see FIG. 7*b*), called a "Leaner", 2 points are scored for the player. Note that points gained from a root "Leaner" as just described are only awarded if root 6 remains leaning against the opponent's stake 2, 4 after the player's turn is completed (i.e., after the step of tossing or rolling ball 8 has been completed by the player as described above).

If root 6 thrown or rolled by a player comes to rest encircling the opponent's stake 2, 4 (see FIG. 7*c*), called a "Ringer", 3 points are scored for the player.

If root 6 thrown or rolled by a player "hangs" from the top of opponent's stake 2, 4 (neither encircling opponent's stake 2, 4, nor touching the ground), 4 points are scored for the player. See FIG. 7*h*.

Throwing Ball 8

If ball 8 thrown or rolled by a player contacts either root 6 or the opponent's stake 2, 4 (see FIG. 7*d*), 1 point is scored for the player for each such contact. A ball 8 contacting either root 6 or the opponent's stake 2, 4 multiple times still scores only one point, unless ball 8 bounces from root 6 to the opponent's stake 2, 4 (or vice versa) and back, in which case additional points for such extra contacts are awarded.

If ball 8 thrown or rolled by a player comes to rest inside root 6 (see FIG. 7*e*), called a "Saturn", or passes through a "Leaner" root, 2 points are scored for the player. Note that in the latter case, the "Leaner" root need not necessarily be leaning against the opponent's stake 2, 4. The "Leaner" root may instead be leaning against any object (such as a fence, a tree, a curb, etc.).

If ball 8 thrown or rolled by a player comes to rest contacting either root 6 or the opponent's stake 2, 4 (see FIG. 7*f*), called a "Leaner", 2 points are scored for the player for each such contact. Therefore, if ball 8 comes to rest contacting both root 6 and opponent's stake 2, 4, the player scores 4 points (two for contacting root 6 and two for contacting opponent's stake 2, 4).

If ball 8 thrown or rolled by a player comes to rest inside root 6, which itself encircles the opponent's stake 2, 4 (see FIG. 7*g*), called a "Game Winner", the player automatically wins the game.

Interference by Opponent

If during a player's turn an opposing player interferes in any way with root 6 (i.e., touches root 6, moves root 6, etc.) the player whose turn it is scores one point for each such interference. In this regard, it should be noted that the opposing player may not touch root 6 until his opponent's turn has been completed.

It will be appreciated that various changes in the details, materials and arrangement of parts which have been herein described and illustrated in order to explain the nature of the present invention may be made by those skilled in the art within the principle and scope of the invention as expressed in the following claims. For example, though the game play of the present invention has been described with the use of two stakes 2, 4, more stakes may be used with two or more teams. Also, it will be appreciated that the game scoring as described above may be significantly altered without departing from the principle and scope of the present invention.

What is claimed is:

1. A method of playing a game, comprising the steps of:

providing at least two stakes separated by a distance;

projecting a ring from behind a first of the at least two stakes toward a second of the at least two stakes;

projecting a ball from behind the first of the at least two stakes toward the second of the at least two stakes or the ring; and scoring points based upon both the projecting of the ring and the projecting of the ball.

2. The method as claimed in claim 1, wherein a score is awarded for touching an opponent's stake with the projected ring, for touching an opponent's stake with the projected ball, for touching the projected ring with the projected ball after the ring has been projected, and for encircling an opponent's stake with the projected ring.

3. The method as claimed in claim 2, wherein a score is awarded when the ring comes to rest touching an opponent's stake, when the ball comes to rest touching an opponent's stake, and when the ball comes to rest within the ring after the ring has been projected.

4. The method as claimed in claim 1, wherein the stakes include at least two portions detachably attached in an end-to-end relationship with one another.

5. The method as claimed in claim 1, wherein at least a portion of the stakes is hollow.

6. The method as claimed in claim 1, wherein the ball is made at least partly of foam material.

7. The method as claimed in claim 1, wherein a player automatically wins the game by encircling an opponent's stake with the projected ring and causing the ball to come to rest within the projected ring.

* * * * *